United States Patent [19]

Masumoto

[11] 4,149,967

[45] Apr. 17, 1979

[54] SHAKING TABLE SORTER OPERATING BY SPECIFIC GRAVITY

[75] Inventor: Toyojiro Masumoto, Musashino, Japan

[73] Assignee: Iony Kabushiki Kaisha, Mitaka, Japan

[21] Appl. No.: 733,905

[22] Filed: Oct. 19, 1976

[30] Foreign Application Priority Data

Oct. 21, 1975 [JP] Japan ..... 50-126549

[51] Int. Cl.[2] ..... B03B 4/00

[52] U.S. Cl. ..... 209/467; 209/481; 209/494

[58] Field of Search ..... 209/467, 472, 480, 481, 209/502, 494, 474

[56] References Cited

U.S. PATENT DOCUMENTS

| | | | |
|---|---|---|---|
| 1,574,637 | 2/1926 | Sutton et al. | 209/467 X |
| 1,786,739 | 12/1930 | Davis | 209/467 |
| 2,150,298 | 3/1939 | Taylor | 209/467 |
| 2,404,414 | 7/1946 | Sutton | 209/467 |
| 2,928,545 | 3/1960 | Forsberg | 209/467 |
| 3,406,824 | 10/1968 | Forsberg | 209/467 |

*Primary Examiner*—Robert J. Spar
*Assistant Examiner*—Charles A. Marmor
*Attorney, Agent, or Firm*—Browdy and Neimark

[57] ABSTRACT

A so-called stone picker is provided with an inclined perforated sorting plate upon which the separating operation of stones and the like from grain is effectively made under the reciprocative oscillation of the plate with wind blowing through parrallel slots and parallel to the direction of said oscillation. Unique constructions of slit openings made in the plate are also disclosed.

4 Claims, 23 Drawing Figures

SHAKING TABLE SORTER OPERATING BY SPECIFIC GRAVITY

This invention relates to a shaking table sorter by specific gravity, which is utilized for picking out from grain foreign materials such as stones and the like which are intermingled into the grain during its harvesting, and which is commonly called as a stone picker.

Though stone pickers of the kind mentioned above are widely employed in the farming industry, conventional ones are not statisfactory on the following points.

Firstly, they can not deal with a large quantity or flow of grain. More specifically, the maximum amount of grain they can treat is 5 tons per an hour, and a stone picker having a larger capacity is not in the market. So, in the factories which deal with a comparatively large amount of grain, it is inevitable to provide a number of pickers, whereby large spaces for installing them are required. In addition, in order to evenly distribute and supply the grain to each of pickers and also to gather the grain from the pickers, it is necessary to provide the pickers with auxiliary machines for attaining the above operations, whereby their installation becomes complicated and expensive. Secondly, conventional ones are not operable fully automatically, since they are provided at their stone discharge openings with manually operated valves and they are opened manually at each time when a certain amount of stones are stored thereto, whereby workers have to be always aside the pickers. Thirdly, because of considerably complicated constructions of shaking tables provided to them, they are expensive. To wit, as a separating plate of conventional pickers which constitutes a shaking table, is made by punching a number of wind holes in a metal plate, and manufacturing costs and labour therefor are high and expensive. Fourthly, the configuration of conventional sorting plates is not adequate for making sorting operations advantageously. To wit, they have generally triangular configurations at their plan views, which are converged towards stone discharge sides, whereby effective storing areas afforded by the sorting plates become nearly only half of the total area taken up. So, in order to have sufficiently wide effective sorting areas, the sorting plates by themselves have to be excessively large.

This invention is, therefore, to provide a novel shaking table sorter by specific gravity which is free from such diadvantages as aforementioned.

The invention shall be explained in more detail hereinunder with reference to the accompanying drawing in which embodiments of this invention are illustrated, while a conventional stone picker is also illustrated for ready comparison thereof with this invention.

Figure 8:
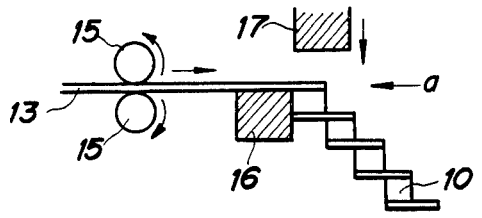
Figure 9:
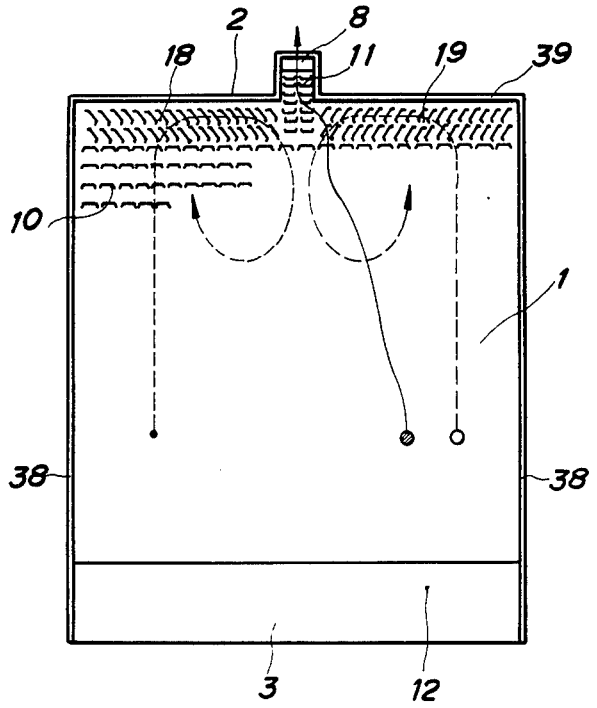
Figure 10:
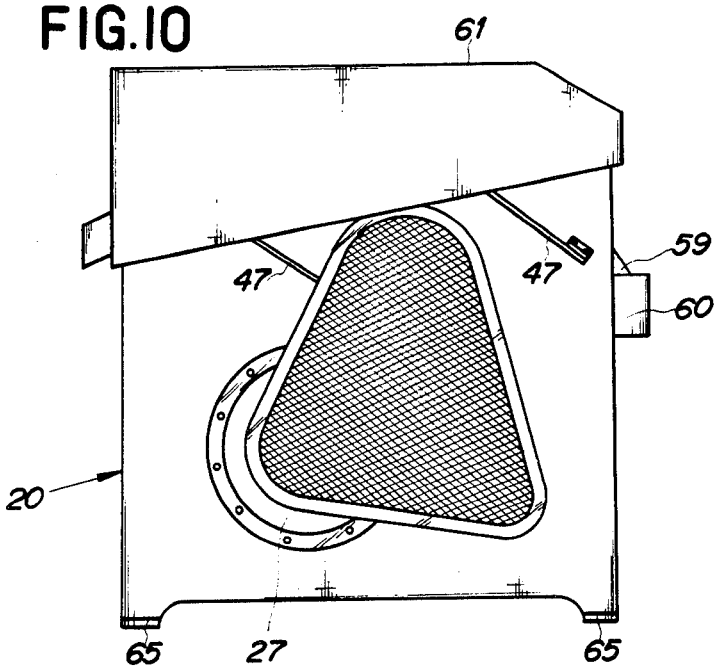
Figure 11:
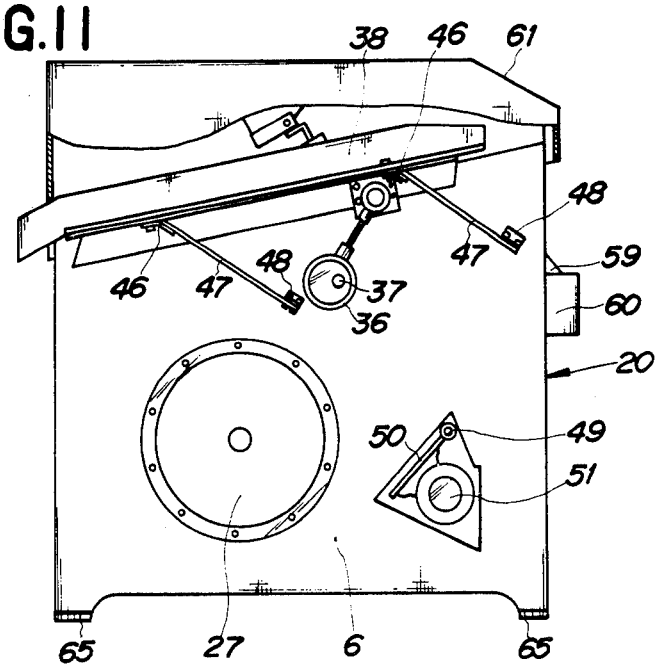
Figure 12:
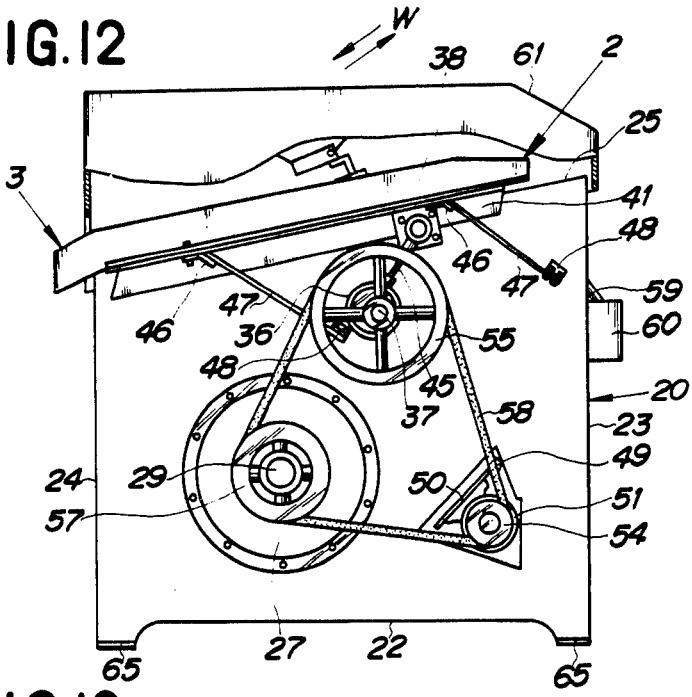
Figure 13:
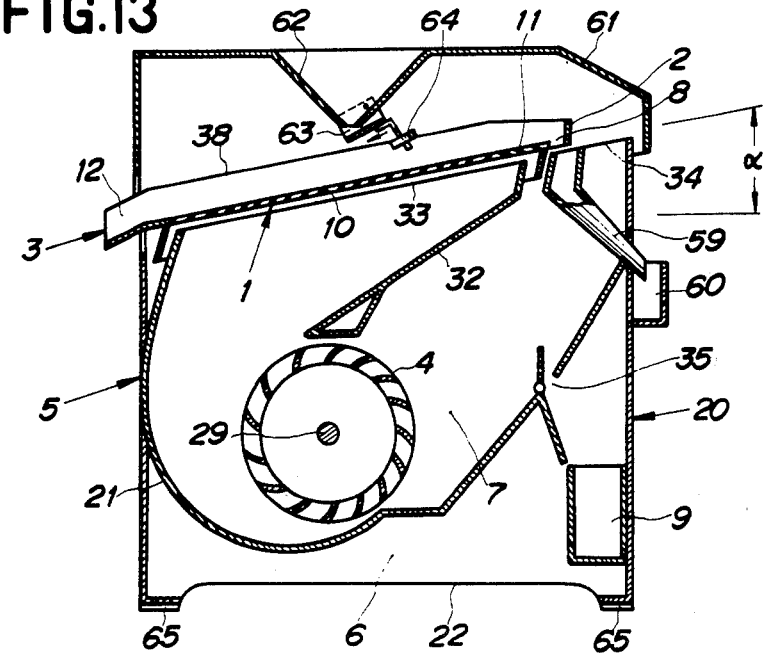
Figure 14:
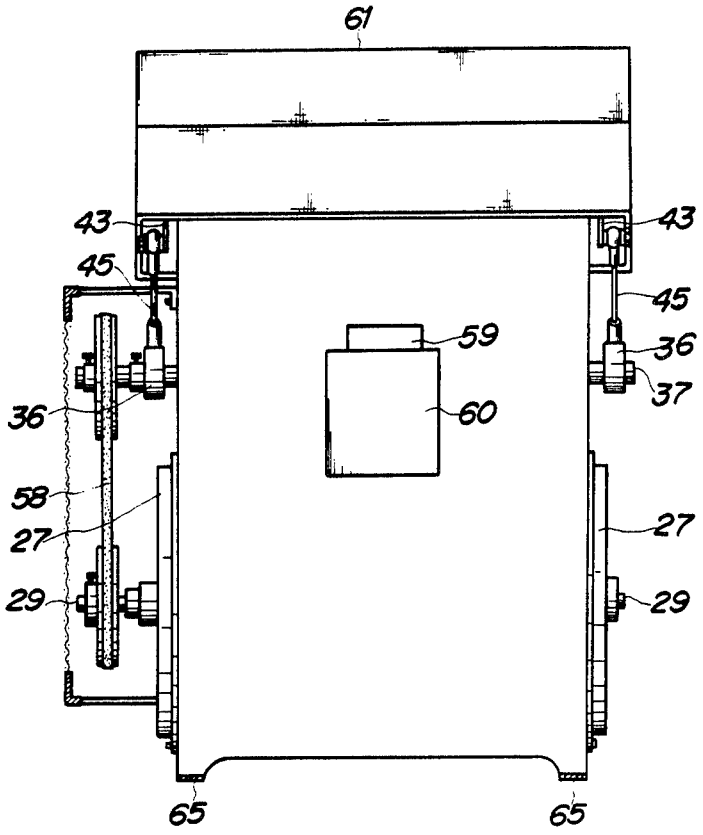
Figure 15:
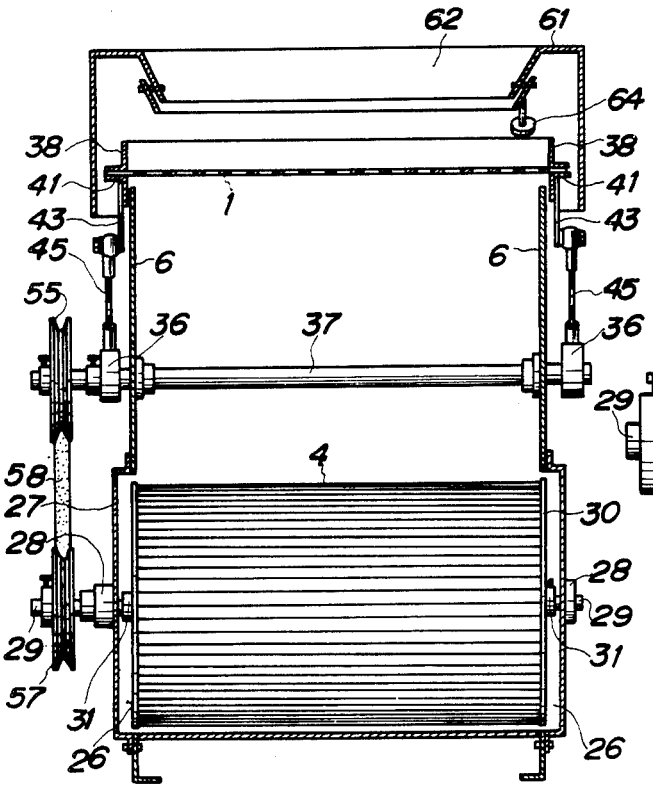
Figure 16:
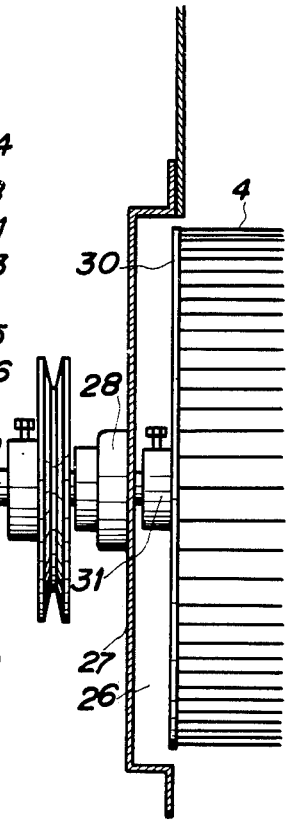
Figure 17:
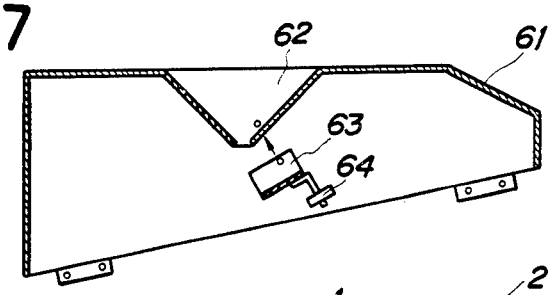
Figure 18:
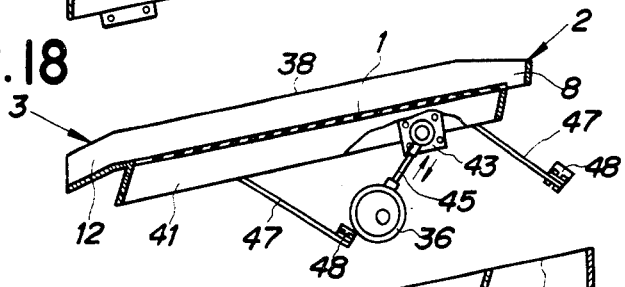
Figure 19:
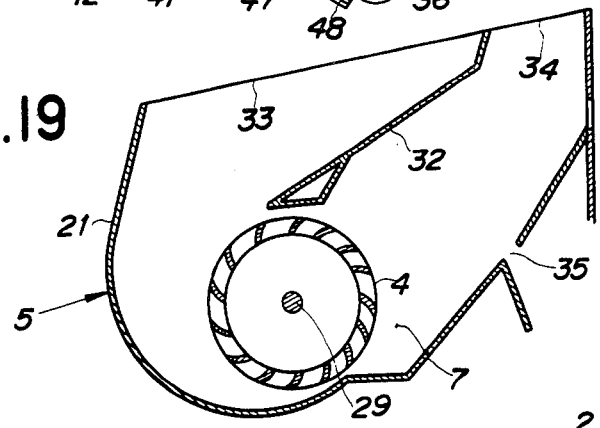
Figure 20:
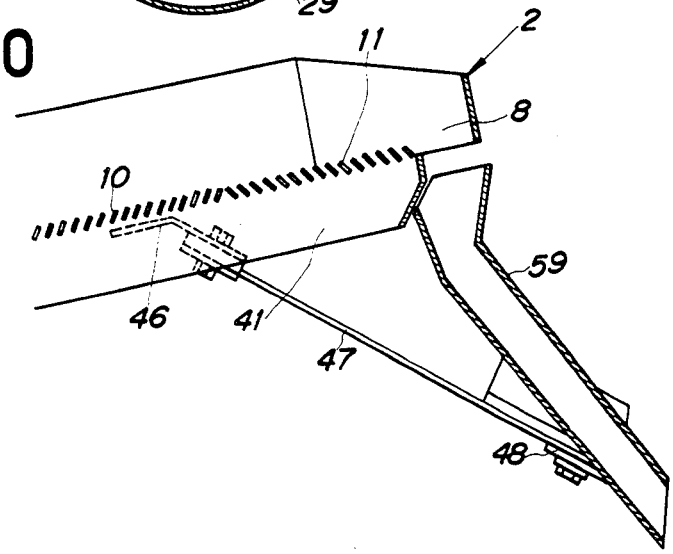
Figure 21:
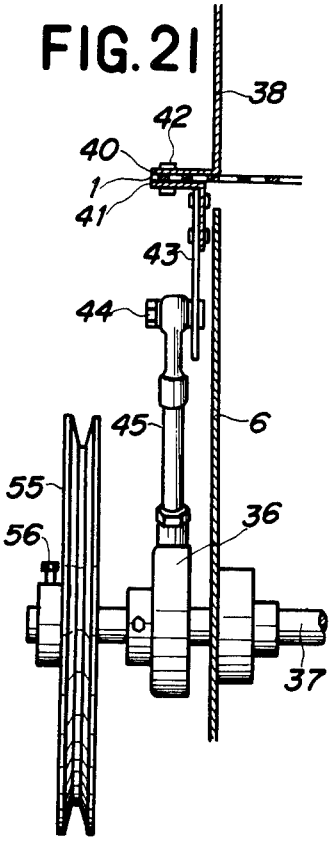
Figure 22:
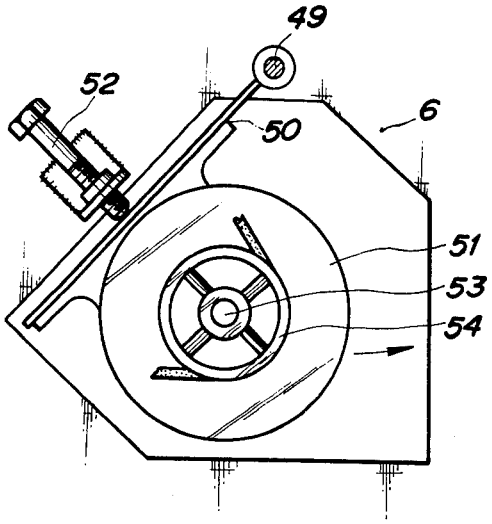

FIGS. 6*a* and 6*b* are plan and sectional views of a conventional sorting plate in its part;

FIGS. 7*a* and 7*b* are views similar to FIGS. 6*a* and 6*b*, but of the plate made in accordance with this invention;

FIG. 8 is a side view schematically illustrating a preferred process for making the present invention sorting plate;

FIG. 9 is an overall plan view of a sorting plate in accordance with this invention;

FIG. 10 is an overall side view of the present invention sorter;

FIG. 11 is a view similar to FIG. 10, but being open its parts;

FIG. 12 is a view similar to FIG. 11, but showing also pulleys and belts provided thereto;

FIG. 13 is a vertical sectional view of the present invention sorter;

FIG. 14 a front view of the same;

FIG. 15 a vertical sectional view of the same;

FIG. 16 an enlarged partial view of FIG. 15;

FIG. 17 a sectional view of a hopper-cover plate;

FIG. 18 a sectional view of the sorting plate;

FIG. 19 a sectional view of a wind barrel;

FIG. 20 an enlarged sectional view of the sorting plate, particularly at its stone discharge side and outlet;

FIG. 21 an enlarged view of devices for oscillating the sorting plate;

FIG. 22 an enlarged side view of a motor and its fixtures; and

Figure 23:
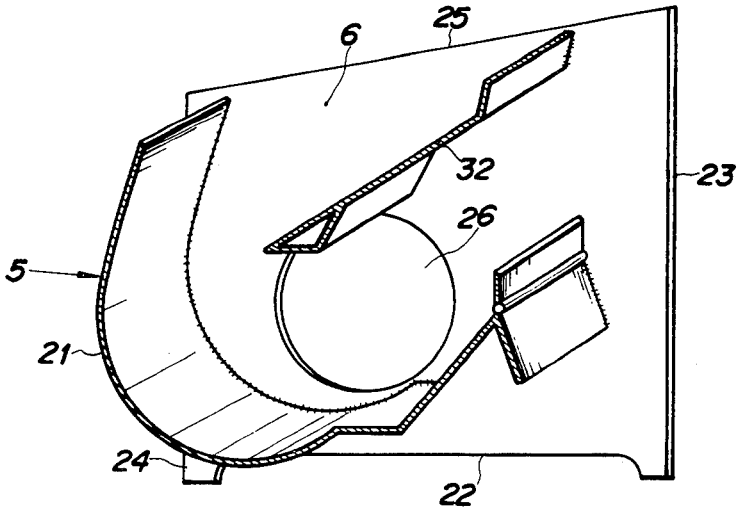

FIG. 23 is a perspective view of the wind barrel.

Figure 1:
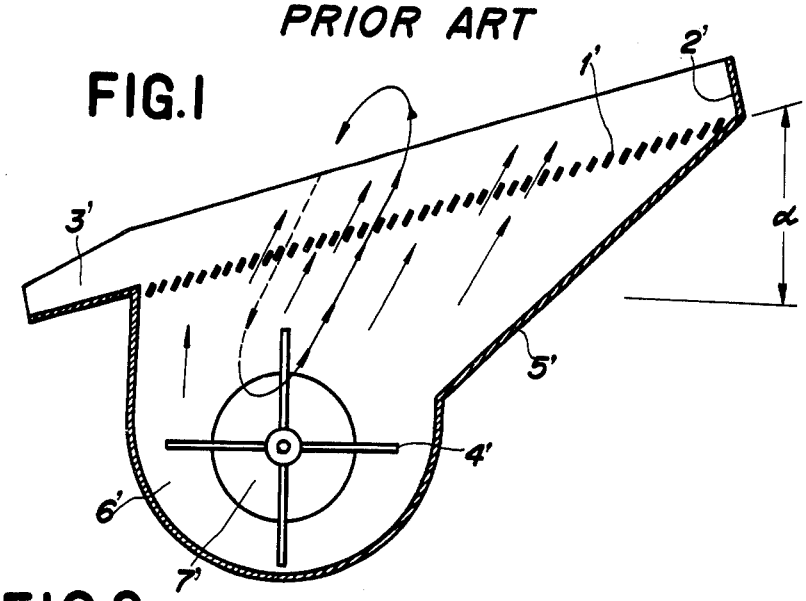
PRIOR ART FIG.1
FIG. 1 is a vertical sectional view of a conventional stone picker in its principal part.

For better understanding of the present invention, firstly, a conventional stone picker is briefly explained with reference to FIGS. 1 and 2.

A perforated sorting plate 1' inclines with an angle $\alpha$ so that its stone discharge side 2' is located at an elevated position and its grain discharge side at a lowered position. There is provided below the sorting plate 1' a fan 4' which drives air upwardly towards the bottom of the plate 1' and therethrough whereby the grain on the plate is subjected to such wind. The wind, which has blown through the sorting plate 1' and the grain thereupon, then returns to suction openings 7', 7' provided in side wall plates 6', 6' of a fan drum 5', and thereby recirculates. In this recirculation as explained above and as schematically illustrated in FIG. 2, the wind emerging from points A, A adjacent to the side wall plates 6', 6' returns to the suction openings 7', 7' via shorter circuits, while the wind emerging from a point B located at or near the center of the device returns to the openings 7', 7' via a circuit longer than the first-mentioned circuits whereby the central wind from B moves a little faster than the wind of B, B and consequently there is produced a difference of velocity therebetween. In other words, the wind from B has a higher velocity than the wind from A, but the former is weaker than the latter. This phenomenon is applicable only when a lateral length l is comparatively short, though the said phenomenon is in any event disadvantageous for effective sorting operations. What is worse, when the length l is made longer so as to increase the efficiency of the picker, all most all the wind introduced from the suction openings to the barrel is blown up at positions adjacent to the side wall plates, and it does not prevail at the point B where the updraft becomes progressively weaker and finally becomes nil. This means that the elongation of the length l of conventional sorting plate has an inherent limitation.

Figure 3:
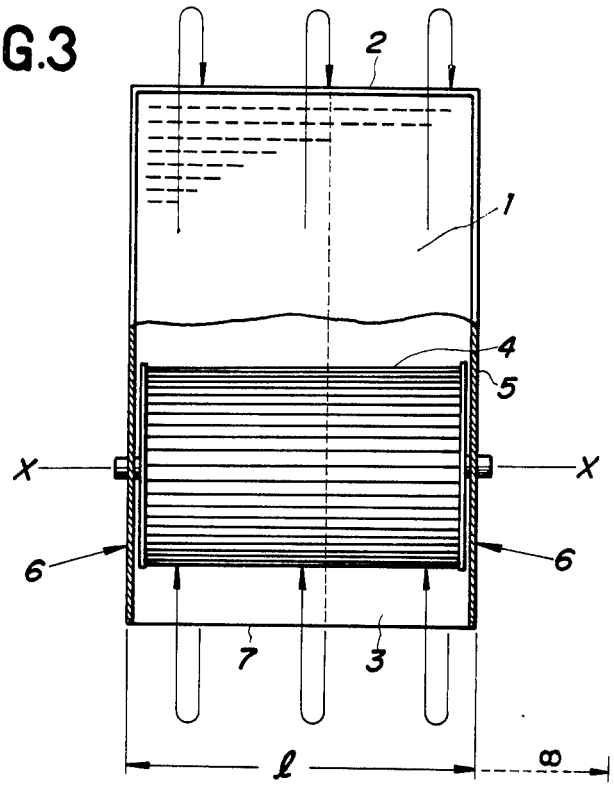
FIG. 3 is a plan view of a principal part of a conventional stone picker which is improved in accordance with the present invention.

In order to eliminate the aforementioned phenomena, in the present invention as illustrated in FIG. 3, side wall plates 6, 6 are completely closed, and a suction opening 7 is provided so as to be on a plane parallel with the axis X—X of the fan 4 which is preferably a multi-blade blower such as a siroco or turboblower. On account of this provisions, winds blown by the fan 4 go forward and cycle at any position along planes transverse to the aforementioned axis X—X and in parallel with each other and return to the suction opening 7, resulting in eliminating the difference of velocities between the winds and in addition, in making it theoretically possible to elongate or extend the lateral length l as wide as desired.

Figure 4:
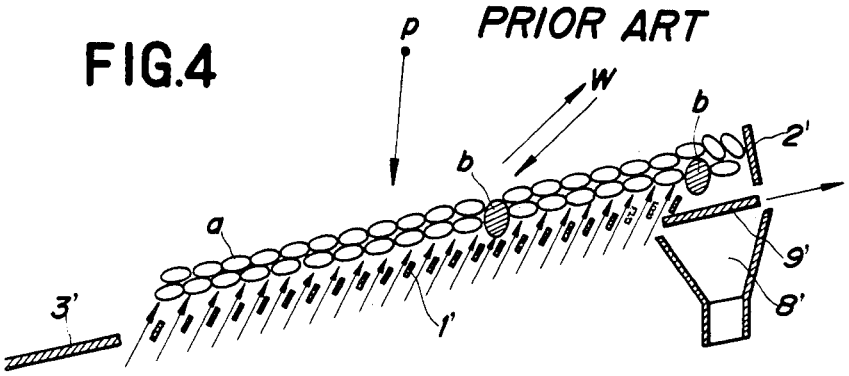
FIG. 4 is an explanatory side view of a sorting plate of the conventional stone picker of the kind illustrated in FIGS. 1 and 2, particularly showing the working principle thereof.
Figure 5:
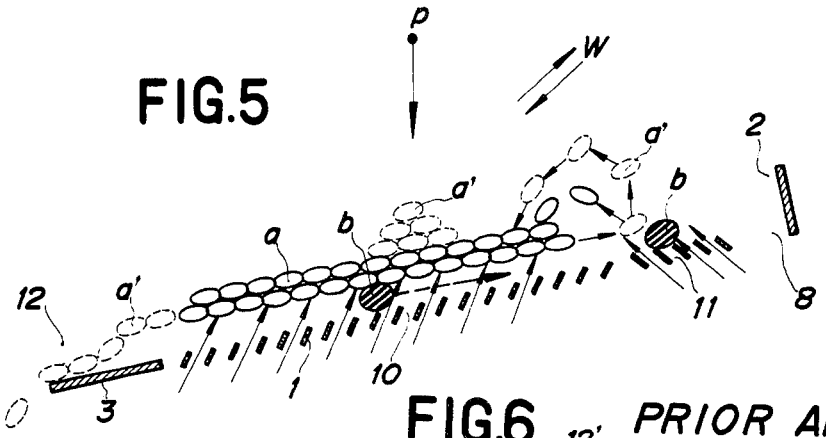
FIG. 5 is a view similar to FIG. 4, but of the sorting plate made in accordance with the present invention.

Nextly, the aforementioned secondary drawback of conventional stone pickers, viz., their improper characteristics for automatic operation are explained more in detail, with reference to FIG. 4 in which separating operations performed by a conventional pick are schematically illustrated. A mixture of grain a and stones b is dropped from a point P onto the perforated sorting plate 1' which is reciprocated in directions indicated by the letter W, whereby stones are separated towards the stone discharge side 2'. When stones are accumulated at said side in a certain amount, a valve 9' is opened and the stones are discharged through a trough 8'. If the valve 9' is kept open, the grain a is also discharged with stones. Hence, in the conventional pickers, the valve 9' is prerequisite, and this valve has to be manually operated. However, in the present invention as illustrated in FIG. 5, there is not provided any valve such as the valve 9', and a stone discharge outlet is made entirely open. To wit, while slits provided to the perforated sorting plate, particularly at its middle or sorting portions open slantedly towards the stone discharge side 2, those slits 11 which are provided to the sorting plate adjacent to the stone discharge outlet open in a direction opposite to that of the slits 10 so as to direct a wind which slants towards a grain discharge side 3. The stone discharge outlet 8 is kept open, as aforementioned. Now, when the sorting plate is reciprocably oscillated or shaken in the directions of arrows W and the grain a is successively supplied from the point P on said plate, the grain is spread over the plate and the stones b mixed with the grain are gradually elevated towards the slits 11 on account of the wind blowing from the slits 10 and the oscillation of the plate in the direction W. It is conceivable that some part of grain ascends upto the slits 11. However, as the wind from the said slits 11 is directed towards the direction from the stone discharge side 2 to the grain discharge side 3, the grain a which has reached nearabout the slits 11 is positively affected by the wind from the slits 11 because it is comparatively light, and it is blown back to where it was. Therefore, on the sorting plate nearabout the boundary between the slits 10 and 11, the grain a is successively blown back, while stones b having a specific gravity heavier than the grain a remain on the slits 11. When additional grain a' is supplied at this stage onto the sorting plate as indicated by dotted lines, it pushes, by its own gravity, the grain a which has been on the plate, whereby the grain a is spread further laterally and discharged from an outlet 12 in an amount corresponding to the additionally supplied grain a'. Those stones which are intermingled in the additional grain a' push a layer of grain aside and reach the slits 11. When the amount of stones on the slits 11 increases they are pushed forward by succeeding stones and successively released from the stone discharge outlet 8.

Figure 6:
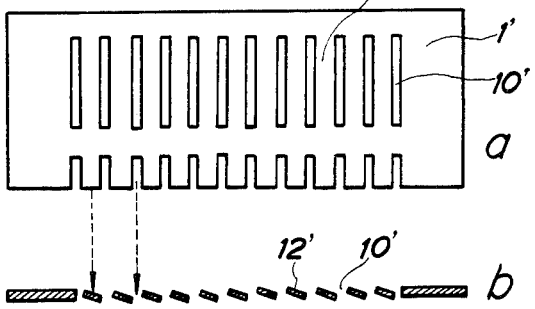
FIG.6 PRIOR ART

Now, the present invention shall be described with reference to the aforementioned third drawback with which conventional stone pickers, more particularly their sorting plates, are accompanied, as illustrated in FIG. 6 which shows a plate cheap in cost.

The aforementioned fourth drawback of conventional shaking plate or table has been eliminated in the present invention, as explained below.

Figure 2:
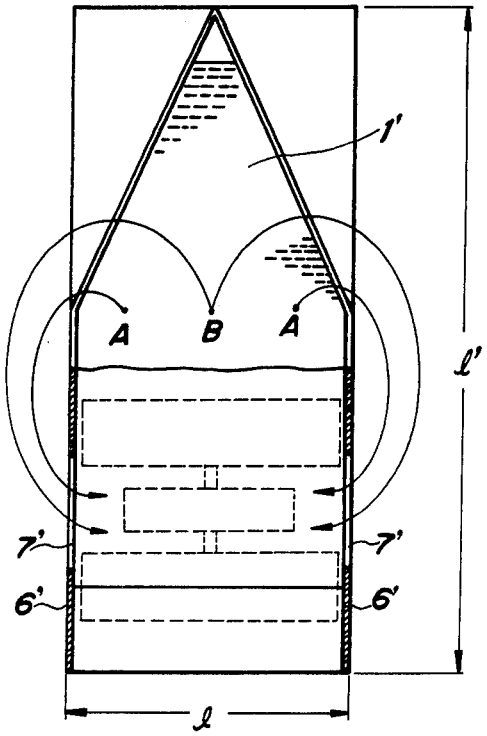
FIG.2 PRIOR ART
FIG. 2 is a plan view of the conventional stone picker illustrated in FIG. 1.
Figure 7:
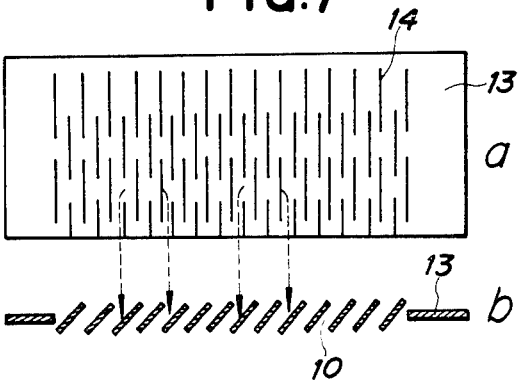

As illustrated in FIG. 2 and as explained briefly with reference thereto, upper halves of conventional sorting plates 1' are commonly made triangular in their plan views, for concentratedly gathering stones above the valve 9'. It shall be readily noticed that a working area afforded by such triangular sorting plate is smaller than an entirely square sorting plate, viz., at a ratio of 1:2. In the present invention, however, the working area of the sorting plate 13, has slit openings 10 each having a hexagonal opening 10. Such slits can be made, for example, by a process illustrated in FIG. 8. The steel sheet 13 nipped between rollers 15, 15 is intermittently forwarded as indicated by an arrow in the drawing, and pressed between upper movable and lower stationary blades 16, 17. As the blades are saw toothed, slits 14 are made zigzag, while they are simultaneously pressed open to hexagonal configurations. In contrast, a conventional perforated sorting plate has a number of narrow oblong openings 10' which have been punched out in a sheet plate, and flat spaces 12' between the openings 10' are bent as indicated in FIG. 6*b*. Such prior constructions require a primary operation for punching out the narrow oblong openings 10' with predetermined spaces therebetween and secondary operation for bending said spaces with desired angles. These operations are not so easy as one considers, and take a lot of time. On the contrary, the sorting or shaking plate employed in the present invention can easily made. To wit, as illustrated in FIG. 7, a number of slits 14 are provided zigzag and in FIG. 9 a group of slit openings indicated by numeral 18 in the drawing directs wind right, while another group 19 directs wind left.

The four novel features and constructions of the present invention which have been described in the above are employed singularly or in combination in embodiments illustrated in FIGS. 10 to 23.

An outer body of the sorter generally indicated by 20 has the lateral side walls 6, between which the wind barrel 5 is formed by means of a curved guide plate 21. Said side walls 6, 6 are flat plates having bottom edges of a shape suitable for locating the body on a floor. While the body is made entirely square, whereby its working area is enlarged, its longitudinal length l' is minimized and the sorter is made compact as a whole. To wit, in FIG. 9, such characteristic features of this invention are structurally illustrated. The perforated sorting plate 1 is made rectangular in its plan view and provided centrally at the stone discharge side 2 with the stone discharge outlet 8 having comparatively wide an inlet opening. The hexagonal split openings located adjacently to the above-mentioned inlet opening are made so as to direct winds therefrom in a direction towards said inlet opening of the outlet 8. More particularly, while the guide plate 21 (FIG. 13) is covered at its front and rear ends by front and rear walls 23, 24 as best shown in FIG. 12, these walls can be eliminated. Upper edges 25 of the side plates 6, 6 are inclined with the angle $\alpha$ so as to correspond with the perforated sorting plate 1 which is mounted over said edges with said angle α. As best shown in FIG. 15, the side wall plates 6,6 have circular holes 26, 26, centers of which are coaxial with a rotary shaft 29 of the multi-blade blower 4. Said holes 26 are respectively covered by a saucer like cover plate 27 upon which bearings 28 for the shaft 29 are fitted. It shall be noted that said holes 26, 26 are not for inducing air into the barrel but for supporting the aforementioned shaft through the bearings thereof. In addition the cover plates 27 which are concaved outwardly can accommodate therein side walls 30 of the blower 4 such as sirocco or turbine fan, whereby turbulent flows of air which are often producible around said walls 30 are prevented from entering into the wind barrel. The aforementioned guide plate 21 has a U-shaped section surrounding the fan or blower 4, and there is provided above the fan in the wind barrel a partition plate 32 which divides the barrel into a suction opening 34 and a blower opening 33. An outlet opening 35 is provided to the guide plate 21 at its portion located blow the suction opening 34, to which a bran receiving box 9 is fitted. Numeral 37 indicates a driving shaft journaled to central portions of side walls 6, 6, and 36 eccentric wheels fitted to the both ends of said driving shaft. Numerals 38 and 39 are vertically extending frames which surround the sorting plate (FIG. 9). Said frame 38 is L-shaped, as best shown in FIGS. 15 and 21, and its laterally extending lug 40 abuts at its bottom with the sorting plate 1 which in turns abuts at its another surface with another L-shaped frame 41. The two frames sandwiching the sorting plate therebetween are fastened by nuts 42. The frame 41 has a lug 43 fitted with an axis 44 which is turn mounted with a rod 45. Said rod 45 is connected at its lower end with the eccentric wheel 38. The L-shaped frame 41 is provided with, as shown in FIG. 20, a fixture metal 46 which is fitted with an upper end of a plate spring 47. The lower end of the spring 47 is fitted to the side wall plate 6 by means of a fixture 48. Said plate spring 47 is maintained, as shown in FIG. 18, at right angles with the rod 45. Below the guide plate 21, there is installed a shaft 49, and a plate 50 is mounted to the shaft 49, which plate 50 is turn fixed with a motor 51. Numeral 52 indicates a screw for adjustably pressing the motor 51 downwardly (FIG. 22).

In the drawing, 31 indicates bosses, 53 a rotary shaft of the motor 51, 54 a pulley fitted to the driving shaft 37, 56 a fixing screw, 57 a pulley fitted to the rotary shaft 29 of the blower 4, 58 a belt, 59 a trough provided below the stone discharge outlet 8, 60 a stone receiving box, 61 a cover plate forming a hopper 62, 63 flow rate adjusting means, 64 a pendulum, and 65 vibration proof rubbres.

The constructions of the present invention thus described can positively achieve the objects mentioned in the preamble of this specification and other objects mentioned in the specification.

What is claimed is:

1. A shaking table sorter for separating stones and the like from grain by specific gravity, which comprises:

an inclined sorting plate having two longitudinally extending sides, a grain discharge rear end and a stone discharge front end, said front end being elevated relative to said rear end; said sorting plate having a plurality of slit openings extending therethrough, at least the majority thereof being inclined towards said front end;

means defining a stone discharge chute opening at the central portion of the front end of the sorting plate, the slit openings on the laterally opposite portions of the sorting plate adjacent said stone delivery chute opening being convergently oriented so as to direct air towards said stone delivery opening;

means to reciprocate said sorting plate in a direction parallel to the inclination of said slit openings; and means to blow air through said slit openings in a direction parallel to the direction of reciprocation and at a rate and magnitude consistent across the width of said sorting plate, said means comprising a wind barrel confined by longitudinally extending side walls and defining a wind passage for directing wind in a generally longitudinal direction, with a suction opening at one end of the wind passage, the suction opening extending transversely to the length of the wind passage; and a multiblade rotary blower in said wind barrel having a shaft extending transversely to the length of the wind passage.

2. A sorter as claimed in claim 1 further having an uncovered chute subjacent said sorting plate at its stone discharge front end opening for freely releasing therefrom stones, and slit openings comparatively closely adjacent to said front end inclined towards the grain discharge rear end.

3. A sorter as claimed in claim 1, in which the slit openings are arranged in parallel rows, each said row being staggered with respect to each adjacent row, and respectively have a hexagonal opening made by vertically stretching a slit.

4. A sorter as claimed in claim 1 wherein said sorter plate is rectangular.

* * * * *